United States Patent [19]

Wojcinski

[11] Patent Number: 4,817,960

[45] Date of Patent: Apr. 4, 1989

[54] PROJECTILE BACKSTOP ASSEMBLY

[76] Inventor: Allan S. Wojcinski, Bonifatiusstr. 86, D-4000 Dusseldorf 11, Fed. Rep. of Germany

[21] Appl. No.: 25,747

[22] Filed: Mar. 13, 1987

[30] Foreign Application Priority Data

Mar. 14, 1986 [DE] Fed. Rep. of Germany ..... 3608651

[51] Int. Cl.[4] ..... F41J 1/12

[52] U.S. Cl. ..... 273/410; 273/404; 73/167

[58] Field of Search ..... 273/404, 410; 73/167

[56] References Cited

U.S. PATENT DOCUMENTS

| | | | |
|---|---|---|---|
| 398,186 | 2/1889 | Rehfuss | 273/404 |
| 523,510 | 7/1894 | Brunswig | 73/167 |
| 840,610 | 1/1907 | Easdale | 273/404 |
| 1,294,407 | 2/1919 | Coryell | 273/410 X |
| 2,422,284 | 6/1947 | Andresen et al. | 73/167 |
| 2,525,843 | 10/1950 | Walker | 73/167 |
| 4,126,311 | 11/1978 | Wagoner | 273/410 |
| 4,317,572 | 3/1982 | Iseli | 273/404 X |

*Primary Examiner*—Paul E. Shapiro

*Attorney, Agent, or Firm*—Anthony A. O'Brien

[57] ABSTRACT

A projectile backstop assembly for decelerating projectiles is disclosed as including a container filled with a liquid for decelerating a projectile, an inlet opening in said container, an elongated sheet of material sealing the inlet opening and a pressure applying frame for pressing the material against the inlet opening, and an advancing mechanism for advancing the elongated sheet of material and thereby replace the pierced part of the sheet with an adjacent unpierced part.

33 Claims, 3 Drawing Sheets

PROJECTILE BACKSTOP ASSEMBLY

The present invention relates to a projectile backstop assembly as recited in the preamble of claim 1.

There has been known a number of projectile backstop assemblies which differ in nature. For example, one prior backstop assembly decelerates the projectiles by means of a plurality of panels which may consist of hard rubber material and are arranged serially one behind the other in parallel with the target surface. One disadvantage of an assembly of this kind, as it is shown in DE-OS specification 28 39 509 FIG. 11), is that its life time is limited as most bullets will strike it in a limited area only, causing panel material to be struck from the impact area particularly of the front panels in the array.

DE-OS specification 31 31 228 discloses another backstop assembly which comprises a plurality of lamellar rows behind the target surface so as to form between the lamellae or between the rows obliquely extending passages substantially perpendicular to the target surface in which the indicent projectiles will be deflected back and forth until they have been decelerated sufficiently.

It is the object of the present invention to provide a projectile backstop assembly which enables incident projectiles to be decelerated more effectively than is possible with the prior assemblies described above.

This object is achieved by means of a projectile backstop assembly of the kind recited hereinabove which is characterized by the features of a liquids filled container and an inlet opening therefor sealed by a sheet capable of being pierced by projectiles.

An essential advantage of the present inventive backstop assembly is that it enables projectiles to be decelerated behind the target surface much more quickly and more effectively than is possible with the prior backstop arrangements.

Advantageously, the sheet of material disposed behind the target surface to cover and seal the inlet opening may be replaced in an extremely simple and rapid manner.

Another advantage of the inventive assembly is that decelerating the projectiles does not call for expensive baffle plates or bullet stopping panels.

Another essential advantage of the inventive projectile backstop assembly is that it will effectively decelerate tracer bullets, too, without creating a fire hazard.

Further embodiments of the present invention are recited in the dependent claims. Thus, one preferred embodiment of the invention provides for a possibility of so moving the material sheet covering the container inlet opening that an area of the rubber sheet from which bullets have struck too much material may be removed from the area of the inlet opening so that the adjacent portions of the rubber sheet will again seal the opening. In another, particularly advantageous embodiment of the invention there is provided below the container a basin or the like structure to collect the liquid which may escape through the material sheet sealing the inlet opening. Liquid may be returned from that basin to the container by means of a pump. This way, the liquid in the container may be maintained at a desired level so that expensive refill operations can be avoided and no liquid will spill to the environment; this will prevent pollution of the environment. Another embodiment of the invention is particularly advantageous in that in case the liquid in the container drops below a desired level a level sensing device will operate to activate the pump automatically to restore the desired level. In this embodiment, the sheet of material sealing the inlet opening of the container may be used until more liquid escapes per unit time through the struck-out portions than the pump can return to the container from the basin. Advantageously, the basin is dimensioned to receive all of the liquid contents of the container. Advantageously, the liquid may be water, which is available anywhere. Preferrably, the inner walls of the container are shaped to have no corners. This way, projectiles striking the inner walls will slide across them without causing harmful pressure build-up, as would be possible of projectiles caught in corners in the inner walls.

In order that the present invention may be better understood, it will now be explained in detail—together with certain embodiments thereof—under reference to the attached Figures.

Figure 1:
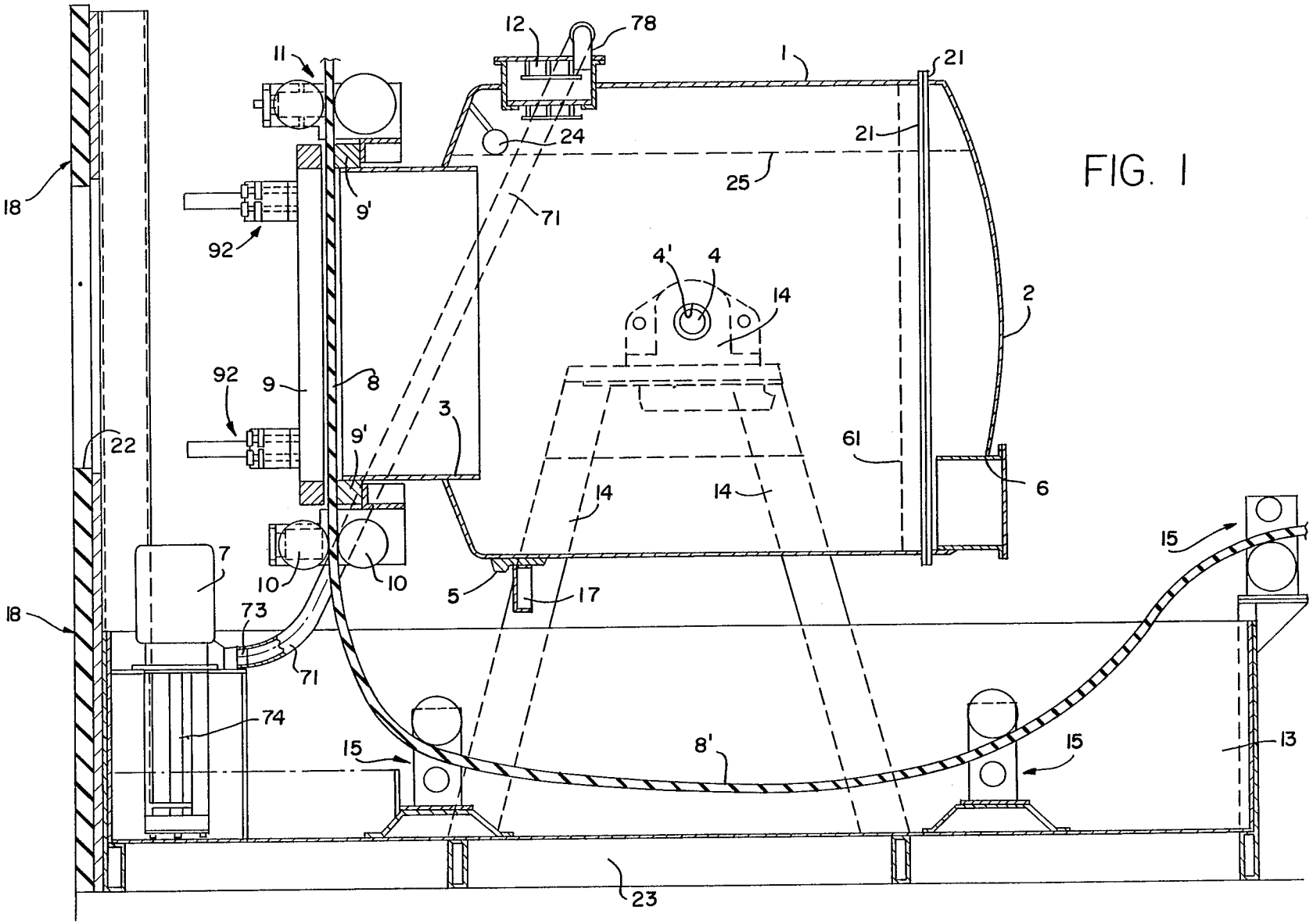
FIG. 1 shows a longitudinal section through the inventive projectile backstop assembly.

Referring now to FIG. 1, there is shown at 1 a boiler-like container. Container 1 preferably has a circular cross section. Also, and preferably, container 1 is closed at its rear end (righthand side in FIG. 1) in a manner such that no corners are formed in the inner walls of container 1. Conveniently, there is provided at the rear end of container 1 a rounded cover 2 which is secured to container 1 with the aid of flanges 21, fasteners such as threaded bolts and sealing means not shown. At the front end of container 1 there is provided an inlet opening 3 which is covered by a sheet 8 of a suitable material, preferably rubber sheeting. Sheet 8 is sealingly urged by a pressure frame 9 onto the edges of inlet opening 3 or onto a flange 9 surrounding that edge so that a liquid in container 1 (which preferably is water) is retained in container 1. In particular, inlet opening 3 may be rectangular in shape and may for example surround an area having dimensions of 600 mm×600 mm.

Conveniently, a front cover panel 18 may be provided in front of inlet opening 3, said panel having therethrough an opening 22 aligned with inlet opening 3.

As is evident particularly in FIG. 1, container 1 is supported for rotation about an axis 4 preferably between opposite mounts 14. Mounts 14 are secured to a base 23 or the like. Base 23 preferably carries a collection vessel or basin 13, the function of which will be explained in greater detail below. It is possible also for basin 13 to serve as a lower securement for mounts 14. In this case, the aforesaid base 23 would not be necessary as the entire assembly would be secured to said basin 13, which itself would be placed on supporting structure. Container 1 is supported for rotation at the ends of mounts 14 remote from basin 13. Preferrably, the walls of container 1 have axles 4 secured thereto by means such as welding to engage mating openings 4' in mounts 14. Axles 4 may have a relatively great diameter so as to provide for the optimum transmission of forces in the area of supporting structure 4, 4'.

In order to maintain the filled container 1 in its normal position with its longitudinal axis in a horizontal plane, there is provided at the front end of container 1 a support 5 which in the normal position of container 1 rests on supporting means 17 secured to a supporting frame or the like. For example, supporting means 17 may comprise—particularly in the manner shown in FIG. 2—a beam extending in a transverse direction between mounts 14. Advantageously, axles 4 may be provided in positions such that the container will by itself rotate to its normal position. Below container 1 there is provided in a convenient manner the previously mentioned basin 13 for receiving water which may escape through inlet opening 3 or through sheet 8. Preferrably, basin 3 is dimensioned so as to receive all of the contents of container 1. To return water from basin 13 to container 1, a pump 7 is preferably provided and an outlet 73 of this pump 7 is connected through conduit or flexible tubing 71 to a discharge assembly 72 extending into the interior of container 1. As shown, pump 7 may be placed at the front end of the container adjacent the front cover panel 18 in a manner such that its intake conduit 74 extends into the basin. However, the pump may be placed elsewhere such as at the top of container 1. Discharge tube 73 of pump 7 is connected through conduit or flexible tube 71 to discharge port assembly 72 communicating with the interior of container 1 for instance adjacent a venting port 12 therein; venting port 12 may be provided at the top of container 1.

It is contemplated to provide basin 13 or, if present, base 23 with wheels or rolls which enable the projectile backstop assembly to be moved in its entirety.

In case a basin 13 is provided, there is mounted inside container 1 a level sensing device 24 (shown schematically only) which acts to automatically activate pump 7 in case the water in container 1 drops below a predetermined level 25. In that case, pump 7 will continue to operate until deactivated by a signal from level sensing device 24 once enough water has been pumped into the container from basin 13 to restore a desired level 25.

At the top of container 1 there is provided the aforementioned venting port 12. A suitable valve may be used at port 12 (not shown) for venting the container in case projectiles entering container 1 cause shock waves to form in the water.

Normally, container 1 will be filled with water to about 90% of its capacity.

There will now be explained in detail the operation of the inventive projectile backstop assembly described above.

Marksmen will shoot bullets through opening 22 in front cover panel 18, which may consist of hard rubber and be mounted in frame structure not shown, towards the sheet of material or rubber covering opening 3. The target area or the target in front of rubber sheet 8 may be of any nature desired. The projectiles or bullets that strike rubber sheet 8 pass through it, with the elasticity of the rubber material causing the holes formed thereby to close after them so that no water will flow out. The water inside container 1 rapidly decelerates the projectiles entering container 1 and causes them to drop to the bottom thereof. The rounded shape of container 1, as described above, is advantageous in that the pulsating shock waves caused by bullet entry into container 1 cannot cause fatigue or wear (as would corners in the inner walls of container 1, for example): projectiles striking the inner walls of container 1 will slide across them until their energy has been dissipated and they drop to the container bottom. As the number of impacts rises, increasing portions of the rubber sheet 8 in front of inlet opening 3 will be struck out so that increasing amounts of water will flow out through rubber sheet 8 or the bullet holes 3 in it; the water will flow into the basin 13 below container 1. As soon as the water level in container 1 drops below the aforementioned level 25, pump 7 will be activated automatically in the manner also described above, causing water to be returned from the collection vessel 13 through intake pipe 71 of pump 7 and through discharge fitting 72 to container 1. This pumping action continues until the desired level 25 has been restored and level sensing device 24 generates another signal to deactivate pump 7. Once enough material has been shot out from rubber sheet 8 over inlet opening 3 so that the predetermined capacity of pump 7 will be unable to maintain level 25 in container 1 at its desired value, rubber sheet 8 will have to be replaced. To this end, container 1 is emptied into basin 13 and pressure frame 9 is disengaged to remove the damaged rubber sheet 8 and to replace it by a new length thereof. After pressure frame 9 has been put in place on container 1 again, the aforesaid new length of rubber sheet is pressed firmly down on the edge areas of inlet opening 3 or on the aforementioned flange surrounding opening 3 so that the new rubber sheet will seal inlet opening 3. Reactivation of pump 7 will cause the water in collection basin 13 to be returned to container 1. Preferrably, an opening 6 is provided at the rear end of container 1 or in its end cover 2 and has a cover placed thereover; this opening may be used for emptying the container 1. Preferrably, opening 6 is located to substantially align its lowermost edge portions with the bottom of container 1 so that the tilting thereof about axles 4 will cause the bullets in it to fall out from opening 6.

There will now be described and explained in detail a mechanism with the aid of which an elongated web of rubber 8′ may be advanced in its longitudinal direction (after pressure frame 9 has been disengaged) in a particularly simple manner so that the damaged portions of rubber web 8′ are removed from the area of inlet opening 3 to be replaced by an adjacent section of rubber material.

In the manner shown in FIG. 1, rubber web 8′ conveniently is guided through basin 13, with guide rolls 15 provided for this purpose. Below inlet opening 3 there is disposed a pair of guide rolls 10 of which the nip is aligned with the plane of rubber web 8′ before pressure frame 9 presses it down against the edges of inlet opening 3 or against the surrounding flange. Above inlet opening 3, there is provided another pair of guide rolls 11, which also are aligned with the aforementioned plane of securement. The aforesaid pairs of guide rolls 10, 11 ensure that rubber web 8′, which advances on guide rolls 15, is moved automatically into the plane required for securement by pressure frame 9. Preferrably, drive means (not shown) may be provided to rotate the upper pair of guide rolls 11 (after container 1 has been emptied and pressure frame 9 has been disengaged) to upwardly withdraw the damaged portions of rubber web 8′ from the area of inlet opening 3 and at the same time to replace these portions by an adjacent undamaged web section. It is contemplated also that guide rolls 10 may be driven instead of guide rolls 11.

In case rubber web 8′ is relatively thin and has a thickness of about 10 mm, for example, it may be withdrawn from supply reel (not shown) located conveniently behind basin 13. In case rubber web 8′ is thicker, i.e. on the order of 30 mm or more, it may be in the form of an elongated web of material 8′ which is advanced in discrete lengths towards in inlet opening 3 in the manner shown generally in FIG. 1.

There will now be described and explained in detail a pressure frame 9 which is used to press rubber sheet 8 against inlet opening 3. Preferrably, the inlet opening 3 has provided along the outer edges thereof the previously mentioned flange 9′ of which the front plane is vertical as container 1 rests on beam 17 in the manner shown in FIG. 1. The rubber sheet 8 to be secured in place is placed on flange 9′ or is supplied in the aforesaid vertical plane by roll pairs 10, 11 in the manner described above. Thereafter, pressure frame 9 is aligned with flange 9′ and pressed down on rubber sheet 8 by suitable means so that sheet 8 will seal the area between flange 9′ and pressure frame 9. It is contemplated also that rubber sheet 8 or rubber web 8′, respectively, may be pressed down by means of a pressure frame 9 directly onto the edges of inlet opening 3 in case the latter does not have a flange 9′ associated therewith. Preferrably, flange 9′ or inlet opening 3 and pressure frame 9 are rectangular in shape, as is shown in particulary by the elevation in FIG. 2. It is envisaged, however, that flange 9′ and pressure frame 9 have a different shape, such as circular. For guiding rubber sheet 8 or rubber web 8′ in the general area of inlet opening 3, lateral guide means 93 may be provided to prevent lateral displacement of rubber sheet 8 in a direction transverse to longitudinal axis 3′ of inlet opening 3. Conveniently, these guide means 93 are vertically spaced along flange 9′ in a manner to project from the front surface thereof towards front cover panel 18, with the distance between opposing surfaces of opposite guide means 93 being dimensioned to be slightly larger than the width of rubber sheet or web 8, 8′

Figure 2:
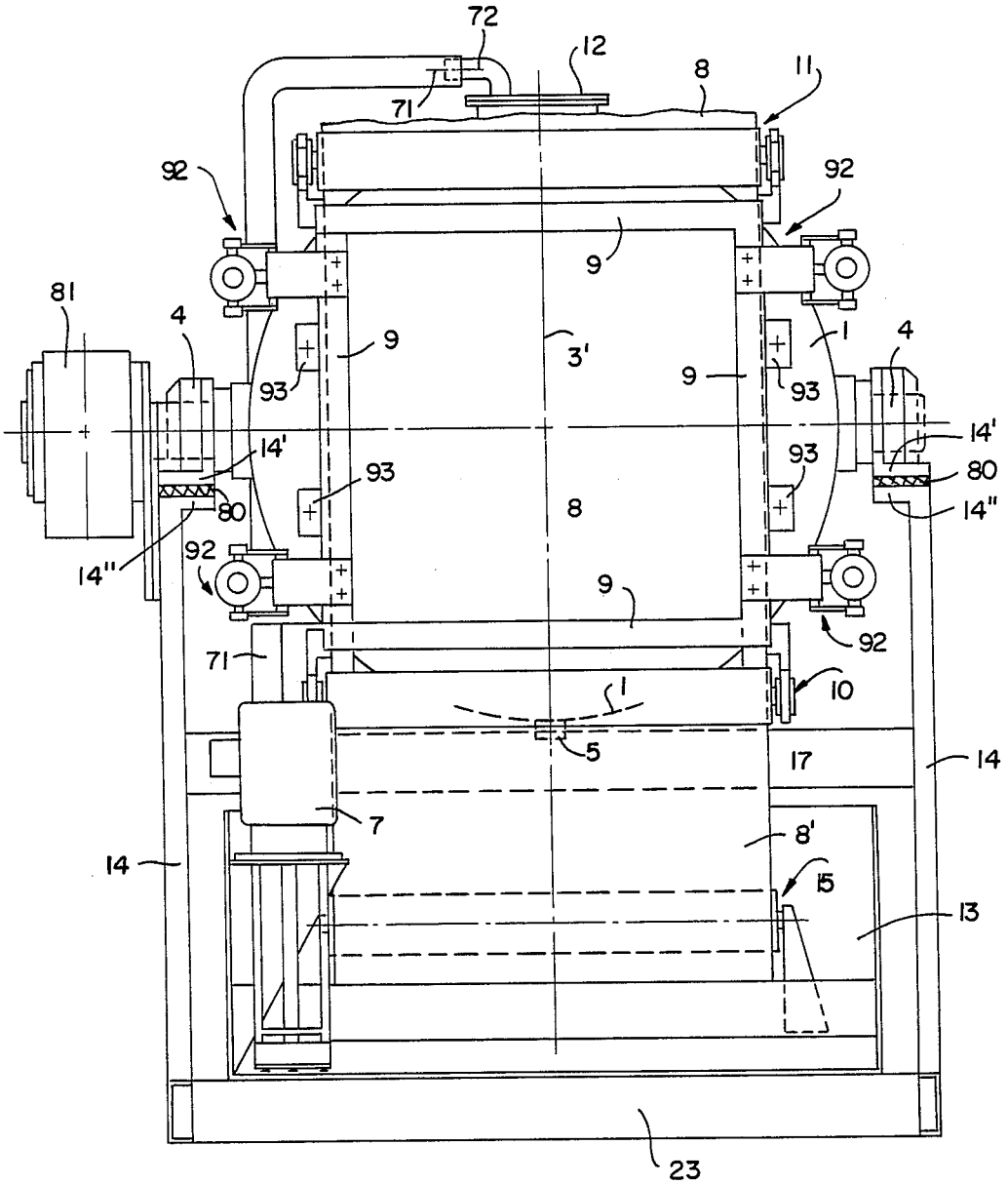
FIG. 2 shows the assembly of FIG. 1 in elevation.
Figure 3:
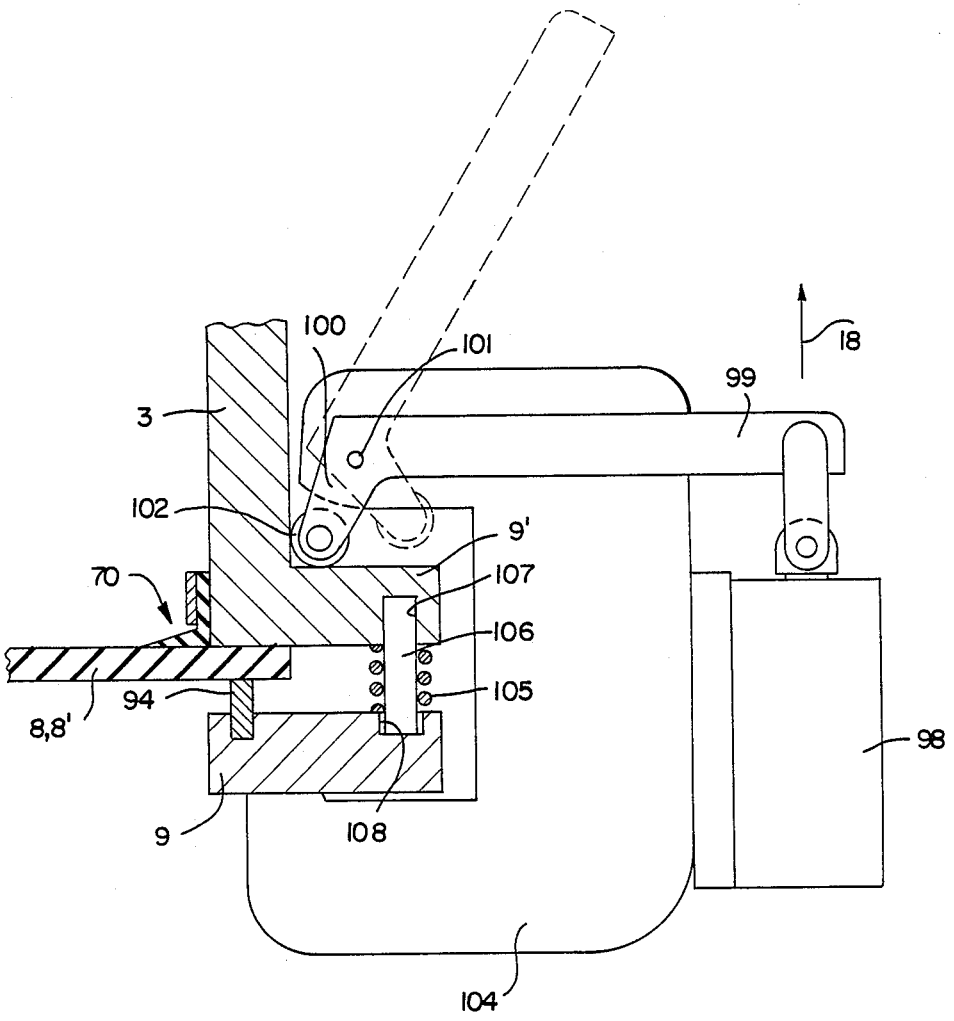
FIG. 3 shows partly in section and partly in elevation a mechanism used for urging the pressure frame onto the sheet of material.

Under reference to FIG. 3, there will now be explained particularly advantageous structure by means of which pressure frame 9 may be engaged and disengaged in a particularly rapid and simple manner. In FIGS. 1 and 2, these pressure means are shown at 92. As illustrated in FIG. 3, which shows a sectional view through a pressure mechanism 92 of this kind, it consists mainly of a U-shaped member 104, an L-shaped lever having a short leg 100 and a long leg 99, and actuating means 98 for moving the lever in the direction of arrow 18. U-shaped member 104, which preferably consists of 30 cm gauge flat steel stock, has the inner surface of one leg thereof joined to pressure frame 9 in the manner shown, preferably by means of threaded fasteners. In this manner, the transversal portion of U-shape will extend from pressure frame 9 towards flange 9′ on inlet opening 3 so that the other leg of the U-shape can extend behind flange 9′ In the area between long leg 99 and short leg 100 the aforesaid lever is mounted for rotation about an axis 101 on the U-shape leg extending behind flange 9′ in a manner such that a roll 102 mounted for rotation adjacent the free end of short leg 100 engages the surface of flange 9′ facing away from pressure frame 9 to roll therealong in case long leg 99 of lever is moved in the direction of arrow 18. Relative to center of rotation 101, roll 102 is placed in a manner such that it may be moved by displacing long leg 99 in the direction of arrow 18 from the stable position shown in FIG. 3, in which it is located on one side of a line extending through center 101 and normally to the engaged surface of flange 9′, into the position shown in phantom in which it is on the other side of the aforesaid line and disengaged from the said surface of flange 9′. In this position, U-shaped member 104 is moved by the force of a spring 105 to disengage pressure frame 9 (joined to U-shaped member 104) from flange 9′ so as to release sheet 8, 8′. Spring 105, which is in the form of a coiled compression spring, is placed preferably over a pin 106 secured in a blind hole 107 in flange 9 to engage a recess 108 in frame 9.

Preferrably, frame 9 exerts pressure on sheet 8 or web 8′ along its periphery through a steel bar 94 so that high pressure will result in the area of the rounded edge thereof which presses down onto sheet 8 or web 8′, causing a perfect and safe seal to be obtained between bar 94, sheet 8 or web 8′ and flange 9′.

In the disengaged condition, frame 9 is held on flange 9′ by pins 105 and the leg of member 104 which extends behind flange 9′.

For engaging and disengaging the pressure mechanism 92, lever 18 may be actuated by suitable electromagnetic or hydraulic means 98 conveniently mounted on U-shaped member 104. Preferrably, and in the manner illustrated in FIG. 2, pressure frame 9 has provided on either side thereof two uniformly spaced pressure mechanisms 92, with each pressure mechanism on one side being aligned with a corresponding pressure mechanism on the other side. Preferrably, the actuating means 98 of all pressure mechanisms 92 are activated simultaneously for engaging or disengaging pressure frame 9.

As projectiles entering container 1 will cause relatively high pressures to act in it which may result in damage in the areas of supporting axles 4, the latter preferably are journalled in blocks 14′ which are connected to mounts 14 through suitable buffer means. Such buffer means may be in the form of buffer pads or hard rubber plates 80 (FIG. 2) placed between blocks 14′ and corresponding supporting surfaces 14″ on mounts 14.

One mount 14 may have secured thereto a motor 81, which preferably may be an electric motor, for rotating container 1 and coupled preferably through a toothed or V-type belt to a sheave connected to axle 4. The provision of a toothed or V-type belt will prevent overload damage to the motor.

In the manner illustrated in FIG. 3, additional supporting means 70 may be provided at the inner edge of inlet opening 3, such means having inwardly projecting edges having supporting surfaces aligned with the surfaces of flange 9′ that engage and support sheet 8 or web 8′.

In the rear portion of container 1 there may be provided in front of the container rear wall a panel 61, as shown in phantom in FIG. 1, for reflecting or stopping projectiles inadvertently fired into a container which does not contain a liquid.

Sheet 8 or web 8′ consists of a material preferably having an elasticity such that openings caused by projectiles passing therethrough will close automatically because of the elastic properties of the material. In particular, the material may be rubber sheeting having a thickness of 10 to 30 mm.

I claim:

1. A projectile backstop assembly for decelerating incident of projectiles comprising a boiler-like container, a liquid filing said container and serving as a decelerating medium for projectiles, said container having inner walls with rounded surfaces and having an inlet opening, an elongated sheet of material having a region adapted to be pierced by a projectile and sealingly closing said inlet opening, a pressure frame adapted to be pressed onto said region of material, pressure applying means to press said pressure frame against the pierced region of said material, means for advancing said elongated sheet along its longitudinal direction after disengaging said pressure frame whereby the pierced region can be replaced by an adjacent region of said elongated sheet.

2. A projectile backstop assembly for decelerating incident projectiles, characterized by comprising a container (1) adapted to be filled with a liquid serving as a decelerating medium for projectiles, said container (1) having an inlet opening (3) therein which is sealed by a sheet of material (8,8') adapted to be pierced by the projectiles, and with said container (1) being mounted on mounts (14, 14) for rotation about a transverse axis (4,4).

3. Assembly as in claim 2, characterized by comprising supporting means (5, 17) by means of which container (1) may be rotated into a position in which is longitudinal axis is substantially horizontal and in which the front edge of inlet opening (3) lies in a vertical plane.

4. Assembly as in any claim 3, characterized in said container being shaped so that its inner walls have rounded surfaces only, but no corners.

5. Assembly as in claim 4, characterized by said container having in the lower portion of the end thereof opposite inlet opening (3) an opening (6) adapted to be sealed by a cover (6).

6. Assembly as in claim 5, characterized in that opening (6) is located so that its lower edge is aligned with inner surface of the lowest portion of the wall of container (1).

7. Assembly as in claim 6, characterized in that container (1) has at its end opposite inlet opening (3) a circularly shaped end cover (2) adapted to be secured through flanges to the cross section of container (1).

8. Assembly as in claim 7, characterized by opening (6) being provided in end cover (2).

9. Assembly as in claim 8, characterized in that said liquid is water.

10. Assembly as in claim 9, characterized in that material sheet (8, 8') consists of an elastic material of rubber.

11. Assembly as in claim 10, characterized by a pressure frame (9) for pressing material sheet (8, 8') over inlet opening (3) so as to tightly seal the latter.

12. Assembly as in claim 11, characterized in that a flange (9') surrounds the edge of inlet opening (3) and engages material sheet (8, 8') and in that pressure frame (9) is constructed to correspond in shape to flange (9') so that said material sheet may be compressed between pressure frame (9) and flange (9') for making a tight seal.

13. Assembly as in claim 12, characterized in that flange (9') and pressure frame (9) are rectangular in shape.

14. Assembly as in claim 12, characterized in that flange (9') and pressure frame (9) are in the shape of a circular ring.

15. Assembly as in claim 14, characterized by a basin (13) placed underneath container (1) to collect liquid therefrom.

16. Assembly as in claim 15 characterized in that basin (13) is dimensioned to receive all of the liquid volume of container (1).

17. Assembly as in claim 16, characterized in that a pump (7) is provided to pump liquid from basin (13) into container (1).

18. Assembly as in claim 17, characterized by a level sensing device (24) disposed inside container (1) to generate an electrical signal for activating pump 7) in case the liquid in container (1) drops below a predetermined level (25), and to generate another electrical signal for deactivating pump (7) in case the liquid in the container reaches or rises above said predetermined level.

19. Assembly as in claim 18, characterized in that the container has a venting port (12) and a venting valve attached thereto.

20. Assembly as in claim 19, characterized by said material sheet being adapted to be advanced over guide rolls (15) and by two pairs of guiderolls (10, 11) being provided one below and one above inlet opening (3) and disposed to advance material web (8') substantially in the plane of the flange (9') surface facing pressure frame (9) and adjacent the edge of inlet opening (3).

21. Assembly as in claim 20, characterized by one of said pairs of guide rolls (10, 11) being adapted to be driven by motor means in a manner such that subsequent to disengagement of pressure frame (9) material web (8') may be moved to replace the portion thereof then in front of inlet opening (3) by an adjacent portion of the web.

22. Assembly as in claim 20, characterized by a front cover panel (18) having therethrough an opening (22) coextensive with inlet opening (3) and placed in front of the latter.

23. Assembly as in claim 22, characterized by a target or a target surface placed between opening (22) in front cover panel (18) and material sheet (8).

24. Assembly as in claim 23, characterized by a pair of axles each axle (4) being journalled in a block (14') coupled through buffer means (80) to mount (14).

25. Assembly as in claim 24, characterized by said buffer means comprising hard rubber discs (80).

26. Assembly as in claim 25, characterized by motor (81) being connected to a sheave coupled to axle (4) through a toothed or V-type belt.

27. Assembly as in claim 24, characterized by a drive motor (81) coupled to one of axes (4) for tilting container (1).

28. Assembly as in claim 26, characterized by pressure frame (9) being adapted to be pressed onto material sheet or web (8, 8') by pressure applying mechanisms (92).

29. Assembly as in claim 28, characterized by said pressure applying mechanisms comprising a U-shaped member (104), by the inner surface of one of the legs of U-shaped member (104) being connected with pressure frame (9) by the transversal portion of U-shaped member (104) extending from pressure frame (9) towards flange (9') of inlet opening (3) in a manner such that the other leg of U-shaped member (104) extends behind flange (9'), by lever means (100, 99) being provided to be actuated so that in its one position said U-shaped member (104) is moved to urge pressure frame (9) against material sheet or web (8, 8') against the force exerted by a compression spring disposed outside the area of material sheet or web (8, 8'), and so that in the other position of lever means (100, 99) said U-shaped member is released to cause the force of compression spring (105) to disengage pressure frame (9) from material sheet or web (8, 8').

30. Assembly as in claim 29, characterized in that said lever means is L-shaped having a short leg (100) and a long leg (99), in that the transition region between short leg (100) and long leg (99) is mounted for rotation about a point (101) on the leg of U-shaped member (104) which extends behind flange (9'), and in that the free end of short leg (100) has journalled thereon a roll (102) adapted to roll between said one and other positions across the surface of flange (9') which faces away from pressure frame (9).

31. Assembly as in claim 30, characterized in that said compression spring comprises a coiled compression spring (105) disposed outside the area of material sheet or web (8, 8') over a pin (106) having one end thereof secured in a blind hole (107) in flange (9') and having its other end engaging a recess (108) in pressure frame (9).

32. Assembly as in claim 31, characterized by said pressure frame having on its surface facing material sheet or web (8, 8') a bar (94) extending along the periphery thereof and adapted to have a rounded end thereof pressed onto material sheet or web (8, 8').

33. Assembly as in claim 30 characterized in, that an actuator means (98) moves said lever means.

* * * * *